US011781415B2

(12) United States Patent
Brenne

(10) Patent No.: US 11,781,415 B2
(45) Date of Patent: Oct. 10, 2023

(54) FLUID FLOW CONDITIONING

(71) Applicant: EQUINOR ENERGY AS, Stavanger (NO)

(72) Inventor: Lars Brenne, Sandnes (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 17/581,210

(22) Filed: Jan. 21, 2022

(65) Prior Publication Data

US 2022/0145743 A1 May 12, 2022

Related U.S. Application Data

(62) Division of application No. 16/500,187, filed as application No. PCT/NO2018/050093 on Apr. 5, 2018, now Pat. No. 11,268,368.

(30) Foreign Application Priority Data

Apr. 5, 2017 (GB) ..... 1705517

(51) Int. Cl.
*E21B 43/12* (2006.01)
*E21B 43/36* (2006.01)
(Continued)

(52) U.S. Cl.
CPC ..... *E21B 43/36* (2013.01); *E21B 43/34* (2013.01); *F04D 31/00* (2013.01); *E21B 43/01* (2013.01); *E21B 43/12* (2013.01); *F04D 27/0261* (2013.01)

(58) Field of Classification Search
CPC ..... E21B 43/12; E21B 43/36; F04D 27/0261; F04D 31/00
See application file for complete search history.

(56) References Cited

U.S. PATENT DOCUMENTS 5,110,264 A * 5/1992 Murry ..... F04D 29/5826 417/18
5,232,475 A * 8/1993 Jepson ..... B01D 19/0031 96/204

(Continued)

FOREIGN PATENT DOCUMENTS

CA 2787991 A1 * 7/2011 ..... H02P 6/28
EP 2 325 494 5/2011

(Continued)

OTHER PUBLICATIONS

International Search Report and Written Opinion of the International Searching Authority dated Jun. 20, 2018 in International (PCT) Application No. PCT/NO2018/050093.

(Continued)

*Primary Examiner* — Matthew R Buck
(74) *Attorney, Agent, or Firm* — Wenderoth, Lind & Ponack, L.L.P.

(57) ABSTRACT

There is provided an apparatus 30 and method for conditioning the flow of a mixed phase flow from a supply pipe 101 from a hydrocarbon well. The apparatus 30 comprises an elongate reservoir 11 having a first end for receiving a multi-phase fluid flow from the supply pipe and a second closed end, there being provided a gas outlet 02 from the upper part of the first end, a liquid separation region downstream of the first end, and a liquid outlet 12 from the lower part of the liquid separation region; and a gas-liquid mixer to which the gas and liquid outlets are connected such that the separated gas and liquid may be recombined. The reservoir 11 may accommodate surges of liquid such that the flow rate from the liquid outlet is relatively invariant over time compared to that of the flow received by the apparatus.

19 Claims, 7 Drawing Sheets

(51) Int. Cl.

| | |
|---|---|
| ***F04D 27/02*** | (2006.01) |
| ***F04D 31/00*** | (2006.01) |
| ***E21B 43/34*** | (2006.01) |
| *E21B 43/01* | (2006.01) |

(56) References Cited

U.S. PATENT DOCUMENTS

| | | | | |
|---|---|---|---|---|
| 7,819,950 | B2 * | 10/2010 | Stinessen | E21B 43/01 166/357 |
| 8,408,879 | B2 * | 4/2013 | Kidd | F04D 31/00 417/423.1 |
| 8,814,990 | B2 * | 8/2014 | Stinessen | B01D 45/00 55/467 |
| 10,801,482 | B2 * | 10/2020 | Xiao | F04B 41/00 |
| 2004/0245182 | A1 * | 12/2004 | Appleford | E21B 43/36 210/170.11 |
| 2005/0006086 | A1 * | 1/2005 | Gramme | B01D 17/044 166/105.5 |
| 2006/0130504 | A1 * | 6/2006 | Agrawal | F25B 49/02 62/181 |
| 2009/0139230 | A1 | 6/2009 | Baldwin et al. | |
| 2009/0200035 | A1 * | 8/2009 | Bjerkreim | F17D 1/14 166/335 |
| 2012/0224980 | A1 * | 9/2012 | Uptigrove | F04D 31/00 417/53 |
| 2014/0216081 | A1 * | 8/2014 | West | F04C 18/0215 62/126 |
| 2016/0333677 | A1 * | 11/2016 | Westberg | F04D 29/5806 |

FOREIGN PATENT DOCUMENTS

| | | | | |
|---|---|---|---|---|
| JP | 3-135398 | | 6/1991 | |
| WO | 2009/131462 | | 10/2009 | |
| WO | WO-2009131462 | A2 * | 10/2009 | E21B 43/01 |
| WO | 2013/189945 | | 12/2013 | |
| WO | 2014/006371 | | 1/2014 | |
| WO | WO-2014006371 | A2 * | 1/2014 | B01D 21/24 |
| WO | 2016/069246 | | 5/2016 | |
| WO | WO-2016069246 | A1 * | 5/2016 | E21B 43/34 |
| WO | 2016/180763 | | 11/2016 | |
| WO | WO-2016180763 | A1 * | 11/2016 | F04B 17/03 |

OTHER PUBLICATIONS

GB Search Report dated Aug. 8, 2017 in corresponding GB Application No. 1705517.9.
GB Search Report dated Feb. 26, 2018 in corresponding GB Application No. 1705517.9.
GB Examination Report dated Apr. 2, 2019 in corresponding GB Application No. 1814334.7.
GB Search Report dated Apr. 1, 2019 in corresponding GB Application No. 1903204.4.

* cited by examiner

Fig 2 - Prior Art

FLUID FLOW CONDITIONING

This application is a divisional of U.S. application Ser. No. 16/500,187, filed Oct. 2, 2019, the entire contents of which are incorporated herein by reference.

The invention relates to the compression of a multi-phase fluid flow, in particular such flow comprising gas and oil and/or water produced from a hydrocarbon well. It particularly relates to the conditioning of the fluid to facilitate its compression for onward transmission.

When hydrocarbon reserves are first exploited, the very high pressures found in the subterranean reservoirs where they are located are generally more than sufficient to allow the hydrocarbons to be produced and, in the case of sub-sea reserves, brought to a platform at the surface at a suitable flow rate. However, this pressure reduces over time as the reserve is exploited. Furthermore, it is desirable to be able to produce hydrocarbons from more marginal reserves that are not at such high pressures.

To enable this, subsea installations require equipment for increasing the pressure in the flow from the wellbore in order to achieve optimum exploitation of the reservoir. This causes a reduction of the downhole pressure in the wellbore, which will then lead to an accelerating production from the reservoir, thereby enabling a stable flow regime.

Prior art solutions include the use of pumps for pumping liquids (water and raw oil, etc.), and mixing of liquid and gas where the liquid represents more than 5% by volume, while compressors which are able to pump wet gas, have been developed.

The present invention relates to the use of compressors to compress multi-phase fluids—i.e. a mixture of liquid and gas—comprising hydrocarbons and often water. Although, as noted, compressors have been developed that can compress such mixtures, they generally require the liquid content of the mixture to be within a certain range and not to vary too much with time. Since the liquids are essentially incompressible and also much denser than the gas, changes in liquid content have a dramatic effect on the load imposed on the compressor. In particular 'slugs' of liquid ingested into a compressor can cause serious problems.

This problem was addressed in the applicant's prior published patent application, WO2009131462, which discloses the use of a flow smoothing device or 'flow conditioner' to treat a mostly-liquid component of the fluid upstream of the compressor. The flow conditioner is designed for receiving a multi-phase flow of mainly hydrocarbons from one or more subsea wells, to transport and secure an even flow of gas and liquid to a wet gas compressor. It involves separating the fluid from the production pipeline into mostly-liquid and mostly-gas flows. The former of these then flows to the flow conditioner, which catches 'slugs' of liquid and acts as a reservoir from which the liquid may flow at a substantially constant rate. Downstream of the flow conditioner, the liquid is mixed back into the mostly-gas flow, the gas content of which may be increased by re-circulated gas, before the mixed multi-phase fluid is fed to the compressor. At the output side of the compressor, a liquid removal device is used to provide the flow of gas for recirculation. The relative gas and liquid flows are adjustable to balance the system in order to provide the desired mixture to the inlet of the compressor.

This prior system is illustrated in FIG. 2 and discussed further in relation to the embodiments of the invention described in more detail below.

Whilst this system is highly effective in providing the desired flow conditioning to allow the compressor to operate, it has the drawback of being bulky in its construction. The flow conditioner reservoir in particular occupies a very large volume and the described arrangement, in which the compressor is placed above it, makes for a very tall and bulky structure. In addition, its design requires the use of relatively small pipe diameters—typically 18"—at the point where the initial separation takes place and consequently the fluid flow velocity is relatively high—typically 10-25 m/s. In such flow conditions, liquid surges tend to disintegrate, so they are not easily separated by the T-pipe flow-separator that is described.

The present invention, at least in its preferred forms, aims to address these and other drawbacks.

According to a first aspect of the invention, there is provided an apparatus for conditioning the flow of a mixed phase flow from a supply pipe from a hydrocarbon well, the apparatus comprising: an elongate reservoir having a first end for receiving a multi-phase fluid flow from the supply pipe and a second closed end, there being provided a gas outlet from the upper part of the first end, a liquid separation region downstream of the first end, and a liquid outlet from the lower part of the liquid separation region; and a gas-liquid mixer to which the gas and liquid outlets are connected such that the separated gas and liquid may be recombined; wherein the reservoir may accommodate surges of liquid such that the flow rate from the liquid outlet is relatively invariant over time compared to that of the flow received by the apparatus.

The apparatus may be for conditioning the flow of a mixed phase flow from a supply pipe from a hydrocarbon well prior to supplying it to a multi-phase compressor. However, it may also be for conditioning such flow prior to supplying it to anything other than a multi-phase compressor. Thus, the apparatus may be for conditioning the flow for supply downstream for any suitable purpose. For example, the apparatus may be for conditioning flow for supply to a transport pipe, a pump, or any other fluid processing machine or device such as a rotating machine or fluid processing device comprising rotating parts. As such, the separated gas and liquid may be recombined for supply to a compressor. Moreover, the gas-liquid mixer to which the gas and liquid outlets are connected may be such that the separated gas and liquid may be recombined for supply downstream for any suitable purpose e.g. to a compressor, pump, transport pipe, or any other fluid processing machine or device such as a rotating machine or fluid processing device comprising rotating parts. Therefore, whilst the description herein refers primarily to a compressor, it will be appreciated that other fluid processing machines, devices, or rotating machines may also be used.

Unlike the prior system described above, this arrangement provides both gas-liquid separation and the slug-catching and reservoir function in a single structure, the elongate reservoir. This significantly simplifies the design.

The outlets referred to may comprise a single conduit or multiple conduits in parallel, as required. The outlets may be formed in walls of the elongate reservoir and extend therefrom.

Moreover, although the elongate reservoir may be a specially-designed vessel, preferably it is a length of the supply pipe from a hydrocarbon well or a pipe similar in diameter thereto. This takes advantage of the very large diameter of such pipes (typically 30"). Thus, by means of the preferred form of the present invention, the pipeline itself may be used to form a separation reservoir, thereby removing the requirement for a separate, bulky component and providing a further design simplification. Indeed, this is regarded as an inventive concept it itself. Thus, another aspect of the invention provides a flow conditioning apparatus comprising a section of supply pipeline as a separation reservoir. The large diameter provided by the supply pipe results in relatively low flow velocity leading to stratified flow and therefore facilitates liquid-gas separation. Accordingly, the reservoir preferably has a diameter of at least 20", preferably 24" and most preferably at least 30", or is otherwise configured to ensure that it receives substantially stratified flow.

In the alternative, where the reservoir is not provided by the supply pipe, the reservoir may have the same or even a smaller diameter than the supply pipe. However, it may have a diameter larger than the supply pipe, and may hence have the advantage that fluid flow therein can be slower so that fluid separation is improved.

The second end of the pipeline (or other vessel forming the reservoir) may be permanently closed off, e.g. by means of a plug or closure plate, but preferably a valve is used for this purpose. This enables the compressor and flow conditioning apparatus to be bypassed if necessary, since by opening the valve the pipeline allows for direct passage of the fluid.

The mixer downstream of the reservoir may be any suitable gas-liquid mixer, for example a Venturi. However, for ease of construction, it is preferred to use a simple T-pipe connector whereby the liquid is directed into the flow of gas.

Whilst in many cases, a sufficient length of the supply pipe will provide an adequate separation reservoir, there may be provided a supplementary reservoir (or a plurality thereof) in series with the elongate reservoir and connected thereto by means of the liquid outlet therefrom.

Preferably, flow control or restriction device(s) are provided in the flow path(s) from the liquid outlet and/or the gas outlet to the mixing device to enable the gas/liquid mixture to be adjusted or pre-set to an optimum level suitable for feeding to the compressor.

Whilst it is possible for the apparatus of the invention to be integrated with the compressor into a single module (as in the prior art system), it is preferred for the compressor to be separate and most preferably remotely located. This reduces the size of the module, allows for optimum location of the compressor and has certain safety benefits. Accordingly, in addition to an outlet for connecting to a flow pipe to the compressor, the apparatus preferably further comprises an inlet for receiving the compressed multi-phase fluid from the compressor and a flow path for returning the compressed fluid to the supply pipe.

Whilst the compressed gas may in some cases be returned directly to the supply pipeline for onward transmission, the apparatus may further comprise a liquid removal device in the flow path for separating gas from the compressed fluid, and a conduit to permit at least some of the separated gas to be mixed into the supply to the compressor. Thus, a gas recirculation system is provided, as in the prior art system. Such recirculation of the separated gas may be controlled to optimize (e.g. adjust or preset) the gas:liquid mixture supplied to the compressor. Typically it may be optimized for the start-up of the field where lower gas velocities are expected and larger liquid transients may take place.

It will be appreciated that the flow conditioner apparatus will normally be used in conjunction with a compressor. Thus, viewed from another aspect, the invention provides the combination of a flow conditioning apparatus, as described above, in combination with a compressor, wherein the compressor is arranged to receive the conditioned multi-phase fluid from the apparatus, compress the multi-phase fluid, and return the fluid to the apparatus.

As noted above, the reservoir is preferably formed by a part of the supply pipeline from a hydrocarbon well into which it is connected. Thus, in such a case, that fluid from the supply line flows directly into the reservoir, which forms an extension thereof, and the compressed multi-phase fluid is returned to the supply line at a downstream location.

The apparatus may be arranged so that during use all fluid flowing from the supply line flows into the reservoir.

The supplementary reservoir may be arranged downstream of the liquid outlet of the elongate reservoir and may be arranged to receive flow therefrom. The supplementary reservoir may be arranged to receive all flow from the liquid outlet of the elongate reservoir. The supplementary reservoir may comprise a gas outlet in an upper portion thereof, and may comprise a liquid outlet in a lower portion thereof. The gas outlet of the supplementary reservoir may be arranged such that gas flowing through it combines with flow from the gas outlet of the elongate reservoir. The apparatus may be arranged so that flow through the liquid outlet of the supplementary reservoir combines with flow from the gas outlet of the elongate reservoir for being provided to the compressor. A valve, restriction or other suitable flow rate control device may be provided downstream of the liquid outlet of the supplementary reservoir to control the rate of liquid flow combining with flow from the gas outlet of the elongate reservoir. The supplementary reservoir may be substantially the same as the elongate reservoir. It may be disposed below the elongate reservoir and arranged such that liquid flows from the elongate reservoir to the supplementary reservoir under gravity. The supplementary reservoir may be closed at both ends so that fluid only enters from the elongate reservoir and leaves via the gas outlet or liquid outlet. The apparatus may be arranged such that liquid may overflow from the supplementary reservoir and into the flow from the gas outlet of the elongate reservoir. For example, liquid may overflow from the supplementary reservoir through its gas outlet.

The apparatus may comprise a plurality of supplementary reservoirs as described. The plurality of supplementary reservoirs may be provided in parallel with each other, and may be arranged so that flow from the elongate reservoir is divided between the supplementary reservoirs. The respective gas outlets of the supplementary reservoirs may be in fluid communication with each other and may be connected by a pipe or pipes. The gas outlets may be arranged so that flow through them combines with flow from the gas outlet of the elongate reservoir. The liquid outlets of each supplementary reservoir may be arranged to combine with flow from the gas outlet of the elongate reservoir all at the same point. That is, the liquid outlets may communicate with each other via a pipe or pipes which join to the flow from the gas outlet. A flow control device may be provided to control the rate of liquid flow from the supplementary reservoirs. The apparatus and supplementary reservoirs may be arranged so that the liquid level in each of them is substantially the same. Joining pipes may be provided directly connecting each of the supplementary reservoirs. The pipes connecting the reservoirs may be open so that there is no flow restriction between reservoirs.

The gas outlet of the elongate reservoir may be arranged to split the flow of gas therein into two flows, and may be arranged to evenly split the flow of gas e.g. so that the same amount of gas is directed to each flow path. For example, a T-pipe may be disposed above the gas outlet of the elongate reservoir. Gas and liquid flow from the supplementary reservoir may be arranged to combine with only one of the two gas flows. The apparatus may be arranged so that gas from the supplementary reservoir joins only one of the two gas flows from the elongate reservoir, whereas liquid joins both of the flows. Flow control devices may be provided to control the flow of liquid from the supplementary reservoir to each of the two flows from the gas outlet of the elongate reservoir. Flow control devices may be provided to control the flows from the gas outlet of the elongate reservoir. Gas and/or liquid flow from the supplementary reservoir may be arranged to combine with flow from both of the gas flows. The apparatus may be arranged so that the liquid flow is equally distributed into each of the two gas flows to ensure evenly distributed glycol and/or anti-hydrate fluid downstream of the apparatus. A plurality of supplementary reservoirs as described above may be used with this arrangement in which the flow of gas from the elongate reservoir is split into two flows.

The supplementary reservoirs may be configured such that they can be installed in a pre-existing flow conditioning apparatus. Thus the present disclosure may provide a method of installing a supplementary reservoir as described herein into a flow conditioning apparatus as described herein, to thereby increase the capacity of the flow conditioning apparatus to accommodate surges of liquid.

The apparatus may be arranged to return a portion of the flow (e.g. of liquid) from the supplementary reservoir to a location upstream of the gas outlet of the elongate reservoir. The apparatus may be arranged to provide a flow of liquid to a point upstream of the elongate reservoir under gravity. Restrictions and/or flow control valves may be provided to control the flow to the upstream location. The apparatus may thus be arranged to prevent a large volume of liquid being forced by gas flow to the compressor downstream of the apparatus during start-up. A valve may be provided downstream of the supplementary reservoir to prevent and/or control flow of the liquid out of the supplementary reservoir, which valve may be used to prevent liquid entering the compressor inlet e.g. during start-up. A bypass pipe may be provided for bypassing the compressor, and a flow control device may be included on the bypass pipe for controlling the flow therethrough.

Accordingly, viewed from another aspect, the invention provides a system for conditioning the flow of a mixed phase flow in a supply pipe from a hydrocarbon well and supplying it to a multi-phase fluid processing device, the system comprising: a portion of the supply pipe, the portion having a closed end whereby a reservoir is formed, there being provided a gas outlet from the upper part of the supply pipe upstream of the closed end, a liquid separation region downstream thereof, and a liquid outlet from the lower part of the liquid separation region; a gas-liquid mixer to which the gas and liquid outlets are connected such that the separated gas and liquid may be recombined for supply to the fluid processing device; a flow path for receiving compressed fluid from the fluid processing device connected to the supply pipe to return the compressed fluid thereto; wherein the reservoir may accommodate surges of liquid such that the flow rate from the liquid outlet is relatively invariant over time compared to that of the flow received by the apparatus.

The multi-phase fluid processing device may be a multi-phase compressor, or may be any suitable fluid processing device as described herein.

Such a system preferably comprises an apparatus having some or all of the preferred features of the first aspect of the invention.

The invention also extends to a corresponding method. Thus, viewed from a still further aspect, the invention provides a method of conditioning the flow of a mixed phase flow from a supply pipe from a hydrocarbon well, the method comprising: receiving the multi-phase fluid from the supply pipe at the first end of an elongate reservoir, the reservoir having a second closed end, there being provided a gas outlet from the upper part of the first end from which gas flows, a liquid separation region downstream of the first end, and a liquid outlet from the lower part of the liquid separation region from which a mostly-liquid containing fluid flows; and wherein the fluids flow to a gas-liquid mixer where the separated gas and liquid are recombined; wherein the reservoir accommodates surges of liquid such that the flow rate from the liquid outlet is relatively invariant over time compared to that of the flow received by the apparatus.

The invention may provide a method of conditioning the flow of a mixed phase flow from a supply pipe from a hydrocarbon well prior to supplying it to a multi-phase compressor, or any suitable fluid processing device as described herein. The separated gas and liquid may be recombined for supply to a compressor, or any suitable fluid processing device as described herein.

The method may further comprise steps corresponding to the use of the preferred features of the apparatus previously described, such as compressing the multi-phase fluid at a remote fluid processing device and returning it to the pipeline.

Likewise, it may also further comprise separating gas from the compressed fluid and recirculating it back through the fluid processing device in order to optimize the mixture supplied to the inlet of the compressor.

The fluid processing device may be a compressor, or any other suitable fluid processing device.

A further aspect of the invention concerns the control of the compressor. It is conventional for such compressors to be controlled using a Variable Speed Drive (VSD) and for such controllers to be operated in relation to various parameters: normally constant discharge pressure; constant speed; or constant torque (torque control). However, the inventors have recognised that, particularly for cases where the motor current or machine torque fluctuations exceed a given threshold, for example 5% (fluctuations are typically 1-2% for only gas), due to imposed highly-varying load from the multi-phase flow, the VSD control mode may be changed to a constant torque control mode. The use of a VSD gives new possibilities of being able to handle torque fluctuations for a multi-phase flow, even when the flow is conditioned.

Thus, viewed from a still further aspect, the invention provides an apparatus for controlling a fluid processing device for compressing a multi-phase flow, wherein, at least under certain conditions (such as those mentioned above), the apparatus maintains the torque driving the compressor at a substantially constant level as the liquid content of the fluid varies with time. It may operate under a different control regime under other conditions. Accordingly, viewed from this aspect, the invention may be regarded as comprising an apparatus for controlling a fluid processing device for compressing a multi-phase flow, wherein the apparatus is configured such that, when the torque fluctuation is above a predetermined threshold, the apparatus switches to controlling the fluid processing device so as to maintains the torque driving the fluid processing device at a substantially constant level as the liquid content of the fluid varies with time. This control regime is referred to as "torque control mode" herein.

The fluid processing device may be a compressor, or may be any suitable fluid processing device as described herein.

This arrangement prevents, or at least reduces, compressor shaft torque variations due to liquid surging, etc.

The threshold may be greater than or equal to 3% or more preferably 5%. Preferably it is less than 10% and more preferably less than 7%. Most preferably the threshold is (at least approximately) 5%.

The apparatus preferably comprises a controller which may be, or include, a variable speed drive (VSD) suitable for operation in torque control mode.

The controller preferably receives and acts upon information about liquid content—e.g. the presence of liquid slugs—upstream of it. This information may be obtained from a suitable multi-phase flow meter. The liquid content passing through the compressor may additionally or alternatively be determined based at least partly on the transient level of electrical current drawn by the compressor since this is known to increase with the liquid content.

In fact, transient mass fluctuation impact on the shaft torque may be identified in any suitable way, for example from a flow measuring device (as noted above), or transient analysis of a differential pressure or local pressure recorded upstream of the machine, or by machine parameters such as motor current, measured shaft speed, shaft position, or bearing coil current. The VSD may be controlled not to operate at a constant torque below a predetermined threshold. This predetermined threshold may be a torque fluctuation of 3%, or more preferably a torque fluctuation of 5%. The predetermined threshold of torque fluctuation may be 10%.

Thus, at least where the controller determines that the liquid transient mass fluctuation impacts (or would impact) the shaft torque by more than the predetermined threshold, the VSD may be switched to a torque control mode so that it adjusts the operational speed to maintain a constant shaft torque level. It may also be switched to another mode below that threshold (or at a lower threshold).

Furthermore, since a greater liquid content results in the compressor generating a higher output pressure, this control regime has the advantage of stabilising the compressor pressure ratio over time.

The fluctuation in torque may be a change in torque per unit time, and may be a change within a timescale of the order of 1 second. The fluctuation of torque may be a change per second. The controller may be configured to switch to the constant torque mode when the change in torque is greater than a predetermined threshold amount (e.g. about 10%) in a predetermined amount of time (e.g. about 1 second). Therefore, the controller may only switch to the constant torque mode if the threshold fluctuation is exceeded and the rate of change of the torque is greater than a predetermined rate.

The invention also extends to a corresponding method. Thus, viewed from yet another aspect, the invention provides a method of controlling a fluid processing device for compressing a multi-phase flow, comprising maintaining the torque driving the fluid processing device at a substantially constant level as the liquid content of the fluid varies with time.

The fluid processing device may be a compressor, any suitable fluid processing device as described herein.

It will be appreciated that the various aspects of the invention described above may be combined in a single installation. The preferred aspects of the invention therefore extend to such combinations.

Certain preferred embodiments of the present invention will now be described by way of example only with reference to the accompanying drawings, in which.

Figure 1:
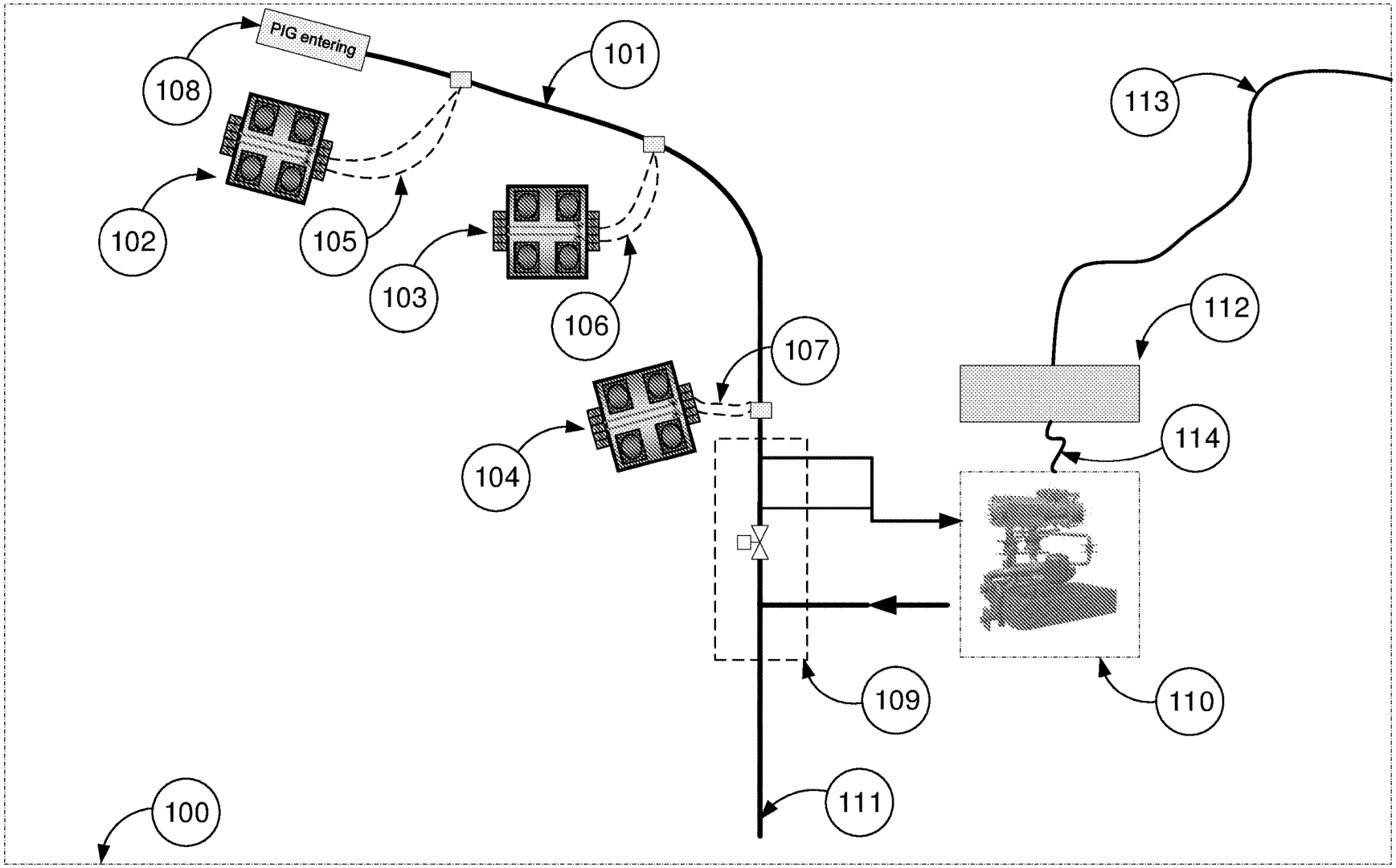
FIG. 1 is a plan view of a subsea installation showing a production pipeline and related components.

Referring first to FIG. 1, there is illustrated a subsea installation 100 showing the relationship between a compressor system and a number of well templates. Specifically, production pipeline 101 receives produced hydrocarbons from wellheads at each of templates 102, 103 and 104 via flexible pipes 105, 106 and 107. In addition, a pig entry unit 108 is provided to allow the pipeline to be pigged when required.

The installation is additionally provided with a subsea compression system that comprises a flow conditioning unit 109 and compressor 110. (The flow conditioning unit replaces a section of pipeline). A jumper 114 connects a controller 112 to the compressor 110. The controller 12 is connected to the shore by cable 113. As is well known in the art, subsea compression systems are provided to allow hydrocarbons to be produced at an acceptable flow rate when the pressure of the underground hydrocarbon reservoir is insufficient, for example after a period of production. The compressed fluid continues onwards at reference 111, eventually to a platform on the surface.

However, where the fluid comprises oil and/or water as well as gas, and is therefore multi-phase, the compression of such fluid is not straightforward. The liquid-phase component is essentially incompressible and is far denser than the gaseous phase. Whilst suitable compressors are able to handle a gaseous flow containing a certain amount of liquids, to facilitate this, the liquid content should be reasonably constant and within an acceptable range. In particular, it is highly undesirable for large "slugs" of liquid to be ingested by the compressor.

Figure 2:
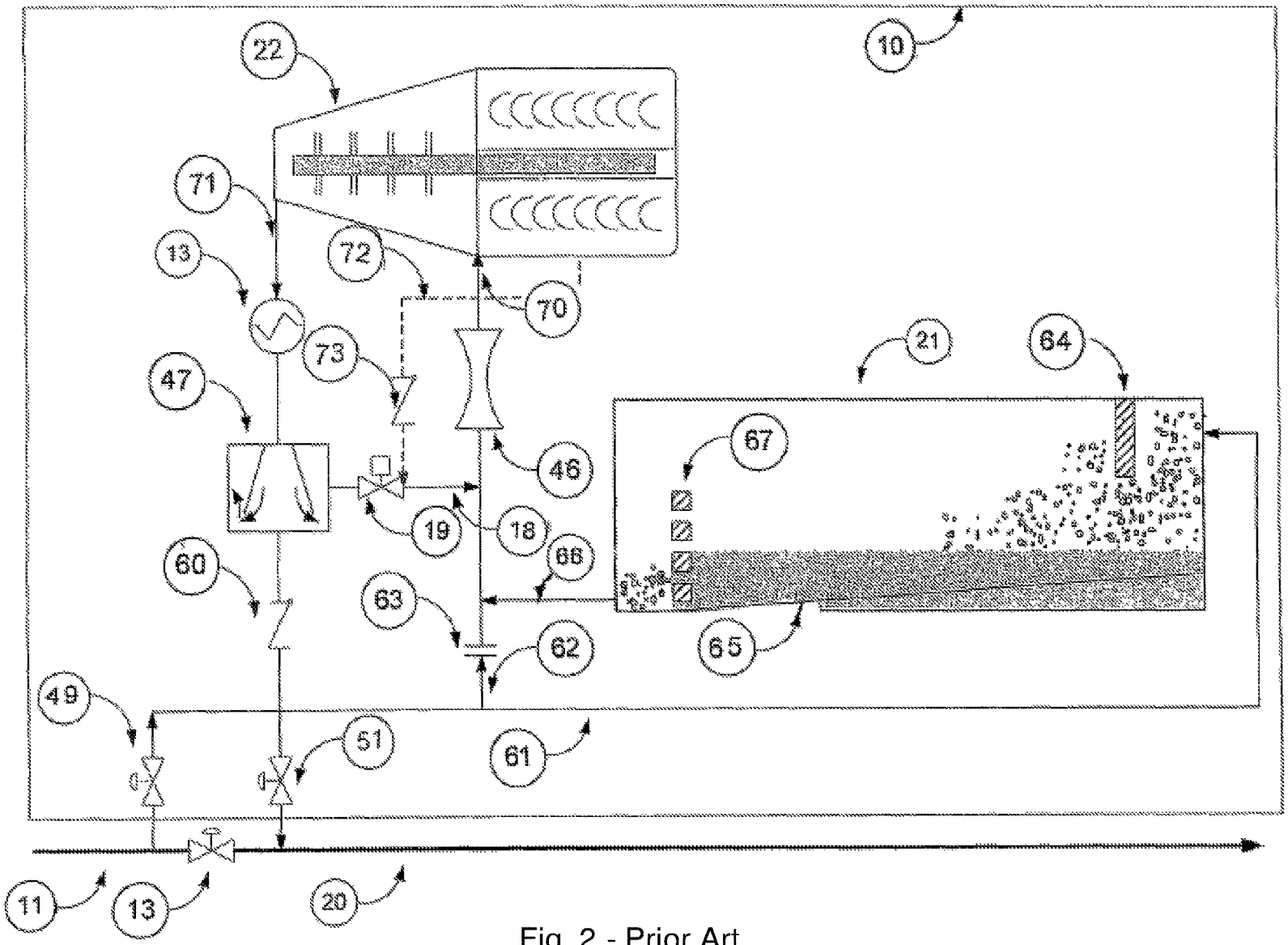
FIG. 2 is a schematic partially-sectional view of a prior art subsea flow conditioning and compressor system.
Figure 3:
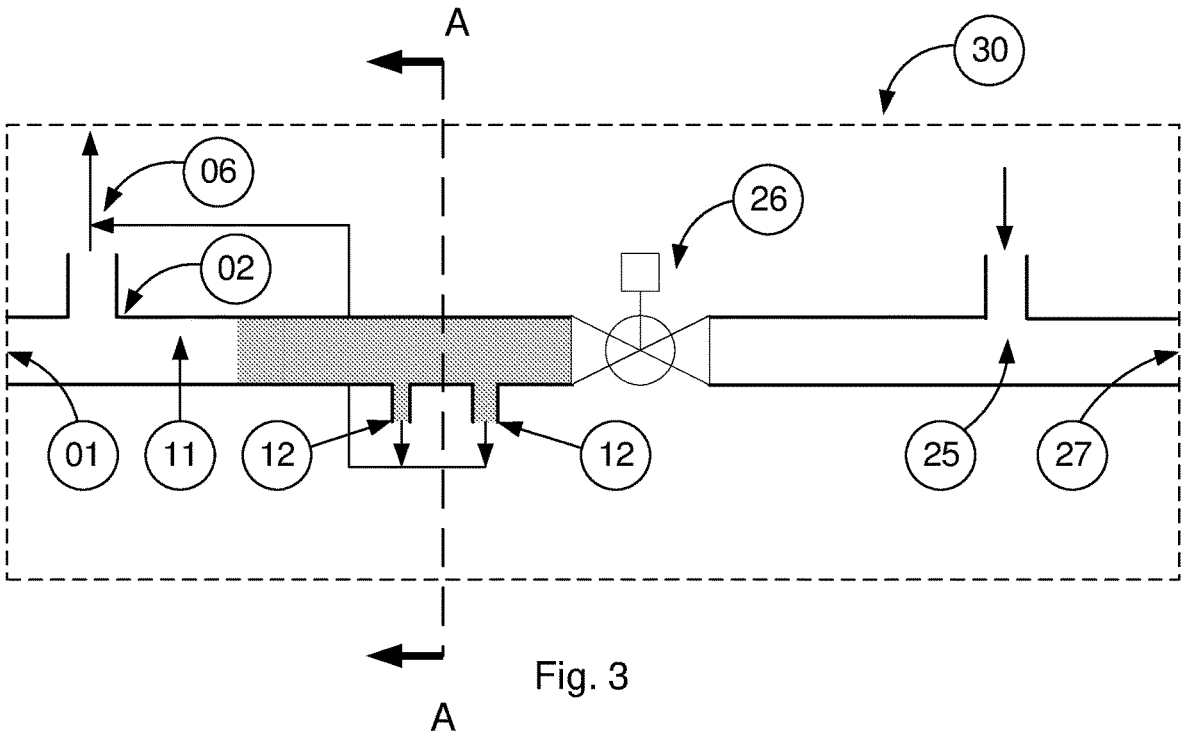
FIG. 3 is a schematic elevation showing an overview of a subsea flow conditioning system according to an embodiment of the invention.

A prior art multi-phase flow conditioning and compressor system 10 (disclosed in the applicant's earlier published patent application WO 2009/131462) is shown in FIG. 2. The flow conditioning system catches slugs of liquid and ensures that the liquid content of the fluid is appropriate. It is in the form of a single module which would correspond to the dashed box shown in FIG. 1, but which contains its own compressor 22 instead of remote compressor 110.

In this figure, pipeline 11, 20 (c.f. reference 101 in FIG. 1) supplies produced fluid from the well heads. (When the pressure of the produced hydrocarbon dropped below a certain level, the module was used to replace a section of the original pipeline.)

Thus, with reference to FIG. 2, a section of pipeline 11, 20 comprising a pair of T-pipes (bottom left, not numbered) and valve 13 are shown inserted into the supply pipeline 101. The remainder of the module is connected to the T-pipes.

When the valve 13 is open, fluids may flow along the pipeline 11, 20 and bypass the module. When the valve is closed, the fluid flow is diverted from the pipeline, via further components discussed below, to the compressor, which then 'sucks' fluid from the well and eventually returns it to part 20 of the pipeline.

It is important to note that, whilst the figure is schematic, it is in the form of a (partly sectioned) elevation; the relative vertical positions of certain components are important and the compressor 22 is located above the other components.

As noted above, the flow is multi-phase—i.e. liquid and gas—so the use of the compressor is not simply due to the large difference in density between these fluids and the variation in liquid content—i.e. there are "surges" or slugs of liquid that it is difficult for the compressor to handle. For this reason, the module includes a "flow conditioner" 21, which acts as a reservoir to catch and store surges/slugs of liquid and then release them at a more steady rate to the compressor. There is also a gas recirculation system to ensure that the correct gas-liquid mixture is provided to the compressor.

The operation of this prior art system will now be discussed in more detail in the case when valve 13 is closed and the compressor is operational.

All fluid from the well head passes from pipeline 11 via valve 49 to line 61. At T-pipe 62, much of the gas is separated from the fluid because the gas is able to flow vertically (the figure is in the vertical plane) towards the compressor 22, whereas the fluid (which is denser and so has much more momentum) will tend to flow onwards to flow conditioner 21.

The detailed operation of the flow conditioner 21 is described in WO 2009/131462. For the present purposes, it is sufficient to note that it acts as a reservoir to catch slugs of liquid and hold the liquid flowing into it and then to release it at a relatively steady rate via line 66 to be mixed back into the line from T-pipe 62.

The system may be balanced (i.e. the relative flows adjusted as desired) by means of flow restrictor 63, which restricts the flow of gas from T-pipe 62 to the mixing point.

The mixed fluids then pass through multi-phase flow meter 46 to compressor 22. The flow meter 46 is used in the control of the compressor, which compresses the fluid.

On the output side of the compressor, separator 47 separates gas, which may be re-circulated back through the compressor in order to provide an optimum gas/liquid mixture. The separated gas flows via valve 19, which controls the amount of gas that is re-circulated.

The remaining fluid is then returned to part 20 of the supply pipe at a T-pipe via valve 51.

In a practical system, the main supply pipe 11, 20, 101 is typically 30" in diameter. The take-off pipe to the compressor is 18" and the discharge pipe from the compressor may be 14" (since the compressed fluid has a smaller volume).

For low liquid velocity, it is relatively easy to separate liquid from gas since there is stratified flow (liquid at the bottom of the pipe). At high liquid flow velocities the gas and liquid are much more intermixed, e.g. as disbursed bubbly flow. The flow velocity will be lower in the larger diameter pipes—in the 30" pipe it will be either stratified (smooth or wavy) or "slug" flow, in the 18" pipe it will be annular (mixed up) flow due to the higher velocity.

These flow characteristics have been taken advantage of in the embodiment of the invention that is shown in the remaining figures.

Returning firstly to FIG. 1, the embodiment comprises a flow control unit or module 30 (c.f. reference 109 of FIG. 1) that is used in combination with a compressor 110. In the illustrated embodiment, the compressor is remotely located, perhaps some hundreds of metres distant, elsewhere on the seabed. However, the compressor and flow conditioning unit may be formed as a single module, as in the prior art system.

The module may be connected into the pipeline by means of Mogrip (proprietary) connectors, which are well-known for interconnecting connecting two pieces of large-diameter pipe in the oil and gas field.

Figure 4:
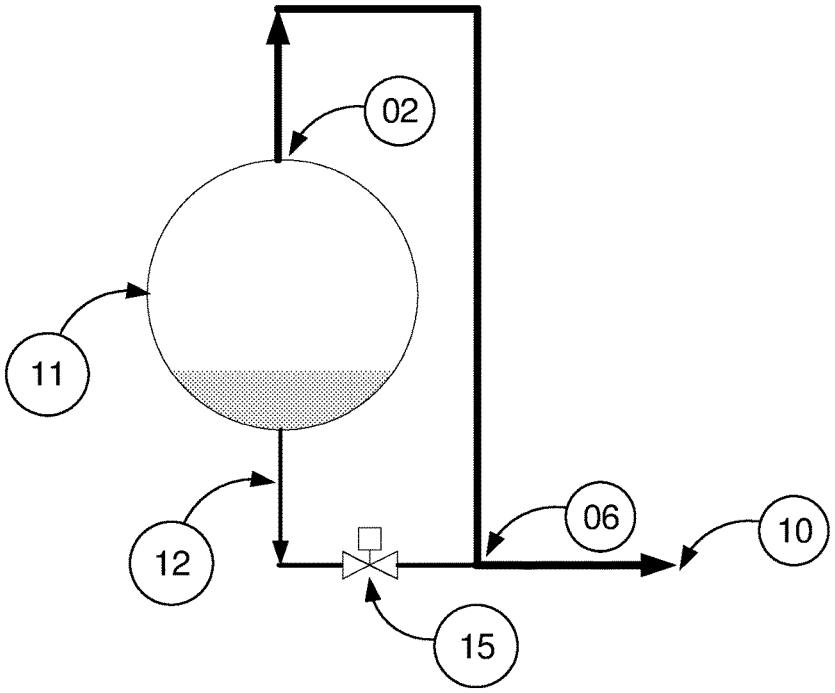
FIG. 4 is a schematic sectional view along line A-A of FIG. 3.
Figure 5:
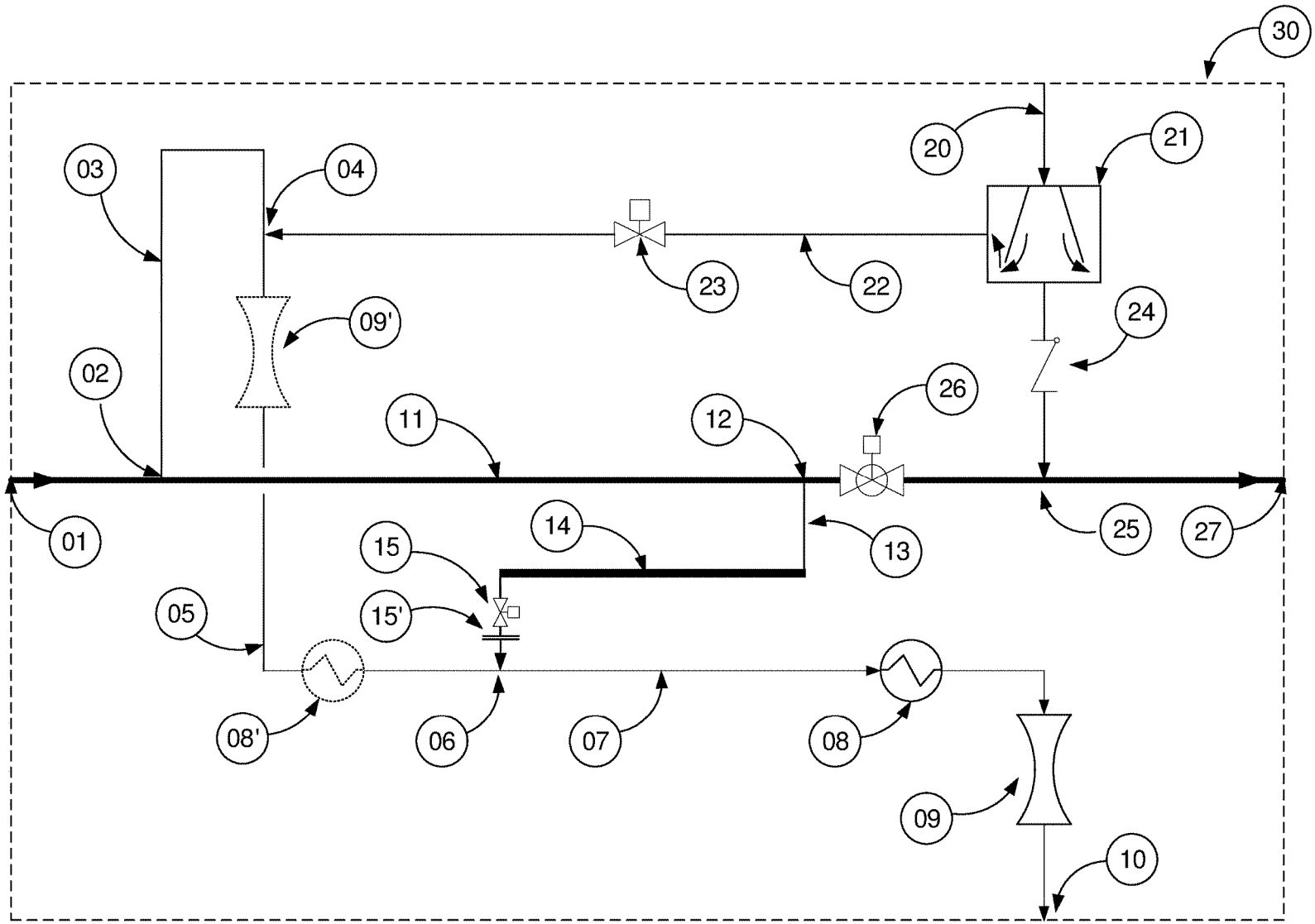
FIG. 5 is a more detailed schematic elevation corresponding generally to FIG. 3.

An important principle underlying its operation may be seen from FIGS. 4 and 5. The stratified or slug flow in the large-diameter main supply pipeline 11 (c.f. 101 of FIG. 1) means that it is well-suited for separating liquid from gas. Accordingly, the shaded region is utilised as a flow-conditioner.

As in the prior art system, a pair of T-pipes 02 and 25 are provided in the supply pipe 11 to allow for fluid flow to and from the compressor respectively. In practice, this is done by replacing a section of the pipe with that shown in the dashed box. The central valve 26 corresponds to valve 13 of the prior art system, though it is located so as to provide a substantial region of pipeline 11 downstream of it. This is provided with a pair of downwardly-directed T-pipes 12.

Thus, the liquid will flow into the shaded region and so, unlike the prior art system, the flow from T-pipe 02 is mostly gas. Since the fluid in the shaded part of the supply pipe has a relatively low flow velocity, the liquid will tend to separate out naturally and settle at the bottom of the pipe, as may be seen from FIG. 5. The downwardly-directed T-pipes 12 then provide a flow path for this liquid to the mixing point 06 where the liquid is mixed back into the flow of gas to the compressor.

Thus, this arrangement avoids the need for a separate flow conditioner, as in the prior art, though supplementary separation devices may be provided (see below). This in turn allows for a much smaller system and in the case of a modular design including a compressor in the module, for a reduced height module since the compressor can be located much closer to the supply pipe. This allows for a significant reduction in the size of that module.

FIG. 5 shows the module 30 of the embodiment in more detail. As shown, pipeline 11 has a first end 01 for connection to the main pipeline from the production templates and a second end 27 for connection to the pipeline leading to the production platform at the surface. As already described, T-pipe 02 provides a connection to allow mostly-gas fluid to flow vertically therefrom, T-pipe 25 provides a further connection to allow compressed fluid to return to the pipeline, and T-pipe 12 provides a downward path for the mostly-liquid flow from the region of pipe 11 shown shaded in FIG. 4. (For simplicity the following comments will refer to liquid and gas flows respectively but it should be born in mind that both of these are multi-phase flows, i.e. they are mostly-liquid and mostly-gas respectively.)

From T-pipe 02, the gas flows along pipe section 03, past T-pipe 04, to further pipe section 05 where it meets T-pipe 06. An alternative gas flow metering device 09' may be disposed downstream of T-pipe 04 and upstream of pipe section 05. An alternative cooler 08' may be positioned upstream of T-pipe 06 and downstream of pipe section 05. Here the separated liquid (see below) is mixed back into the gas flow. From there the combined fluids flow via further pipe section 07 to optional cooler 08 and then via multi-phase flow meter 09 to outlet 10 leading to the remote compressor 110 (FIG. 1). The multi-phase flow meter 09 may be optional. If the cooler 08' is used then liquid from the supplementary reservoir 14 may have a higher temperature than the gas at the T-pipe 06 where mixing occurs.

Returning to the flow into pipeline 11, as previously described, the liquid settles to the bottom of the shaded part (FIG. 4) of pipeline 11, which it then leaves under gravity via T-pipe 12 and flows via flow restrictor 15 to T-pipe 06 where it is mixed into the gas flow in pipe section 05, as discussed above. An alternative liquid flow metering device 15' may be included to control the flow. The flow restrictor 15 may be used to adjust the system to obtain the desired mixture of liquid and gas in pipe section 07. The flow restrictor 15 may be used to adjust the system flow resistance to obtain the desired mixture of liquid and gas in pipe section 07. It could also provide the functionality of liquid flow metering device 15', depending on the type of flow restrictor used. The use of the flow metering devices 09' and 15' may provide a more accurate flow metering compared to device 09, however the actual selected combination may depend on the application.

It will be noted that FIG. 5 shows an optional additional separation volume 14, which may be provided to augment the separation that occurs in the separator part of pipeline 11. As shown, it is in series with the separator part of the pipeline and connected to it by means of pipe section 13. Alternatively, the length of the separator section of pipeline 11 may be extended by changing the relative locations of the T-pipe 02 and valve 26.

Referring to the upper part of the figure, the return (compressed) flow from the compressor enters the module via pipe section 20. The remaining steps are similar to the prior system in that the multi-phase flow passes to separator 21 from which a portion of the gas flows via pipe section 22 and control valve 23 to T-pipe 04 where it is returned to the input gas flow. This provides controlled recirculation in order to balance the oil-gas mixture flowing to the compressor. The mixed phase flow (except the re-circulated gas portion) is returned to the pipeline at T-pipe 25 for onward transmission.

The system is balanced by a combination of adjustments to the flow restrictor 15, which changes the flow of (mostly) liquid into the flow to the compressor and valve 23, which adjusts the amount of re-circulated gas flowing to it.

Figure 6:
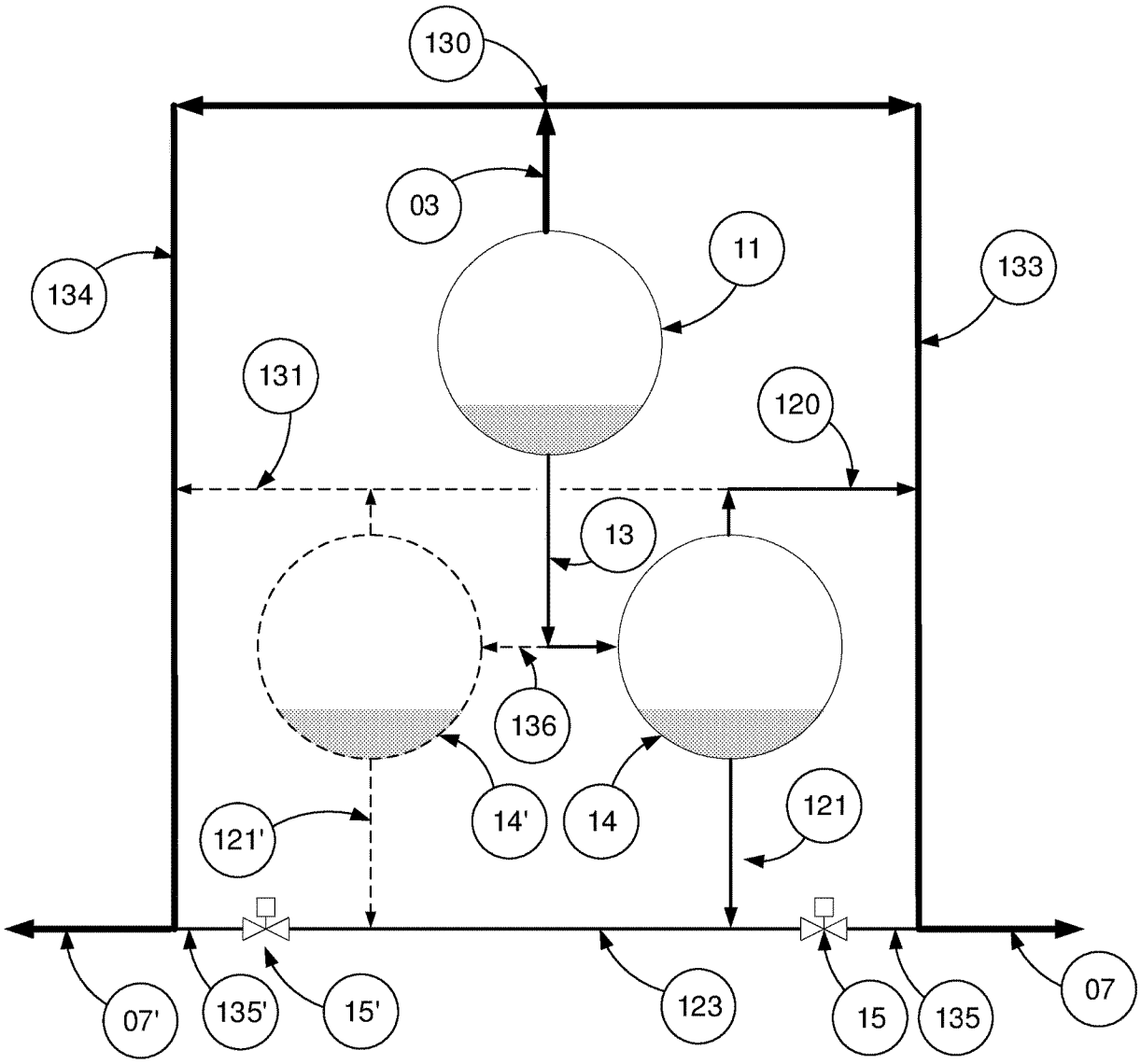
FIG. 6 shows a schematic sectional view of an alternative flow conditioning system according to an embodiment of the invention.

FIG. 6 shows a sectional view of an apparatus for conditioning flow comprising an additional separation volume or supplementary reservoir 14. The supplementary reservoir 14 is arranged to receive flow from a pipe section 13, which itself receives liquid flow from the liquid outlet of the elongate reservoir 11. The pipe section 13 is shown in FIG. 6 connecting to the supplementary reservoir at a point half-way up the pipe, but it will be appreciated that the pipe section 13 may communicate with the supplementary reservoir at any suitable position. The supplementary reservoir 14 has a gas outlet in an upper section which permits gas flow via pipe section 120 to combine with gas from the elongate reservoir 11 in pipe 133. Liquid may leave the supplementary reservoir 14 via a liquid outlet in a lower portion into pipe 121. That liquid is combined with gas flow from T-pipe 03 via pipe 123 and into pipe 134. Valves 15 and 15' are arranged to control the flow of liquid from the supplementary reservoir into pipes 133 and 134 via pipes 135 and 135' respectively. Flow from pipe 133 enters pipe 07, and flow from pipe 134 enters pipe 07'. The pipes 07 and 07' may be arranged to transport flow of liquid and gas, and may or may not be connected downstream to a compressor or the like. They may serve to reduce the pressure drop in the system.

The apparatus of FIG. 6 also comprises a T-pipe 130 connected to the T-pipe 03 which serves as the gas outlet of the elongate reservoir 11. As such, gas from the elongate reservoir 11 is split into two parallel flows in pipes 133 and 134. The gas and liquid from the supplementary reservoir 14 is combined with gas flow in the pipes 133 and 134 as described above via valves 15 and 15' or other suitable flow restrictors. Flow restrictors or the like may also be used on pipes 133 and 134 to provide greater control over the flows therein and allow balanced mixing of gas/liquid and water to control hydrate occurrence.

A second supplementary reservoir 14' may be included, as well as a pipe section 136 arranged to receive flow from the elongate reservoir 11 and pass that flow to the second supplementary reservoir 14'. The liquid from the elongate reservoir 11 may be evenly distributed to the first and second supplementary reservoirs 14 and 14' e.g. by gravity. Pipes 131 and 121' may also be provided to permit combination of gas and liquid respectively with the flow from T-pipe 130 in pipes 133 and 134. The arrangement of the second supplementary reservoir 14' may be the same as for that of the supplementary reservoir 14, albeit in relation to pipe 134 instead of pipe 133.

The arrangement shown in FIG. 6 may allow liquid levels in the first and second supplementary reservoirs 14 and 14' to be balanced so that an equal liquid injection rate is achieved. It may also allow via valves 15 and 15' the liquid to be evenly distributed into the two gas pipes 133 and 134, which even distribution may ensure evenly distributed glycol and/or anti-hydrate fluid for the downstream gas-condensate transportation system. Flow restrictors or the like may be provided on pipes 133 and 134 to provide control over the flows therein and hence may be used to exercise further control over the combination of gas and liquid. Finally the produced gas and liquid is distributed evenly into pipes 07 and 07'.

Figure 7:
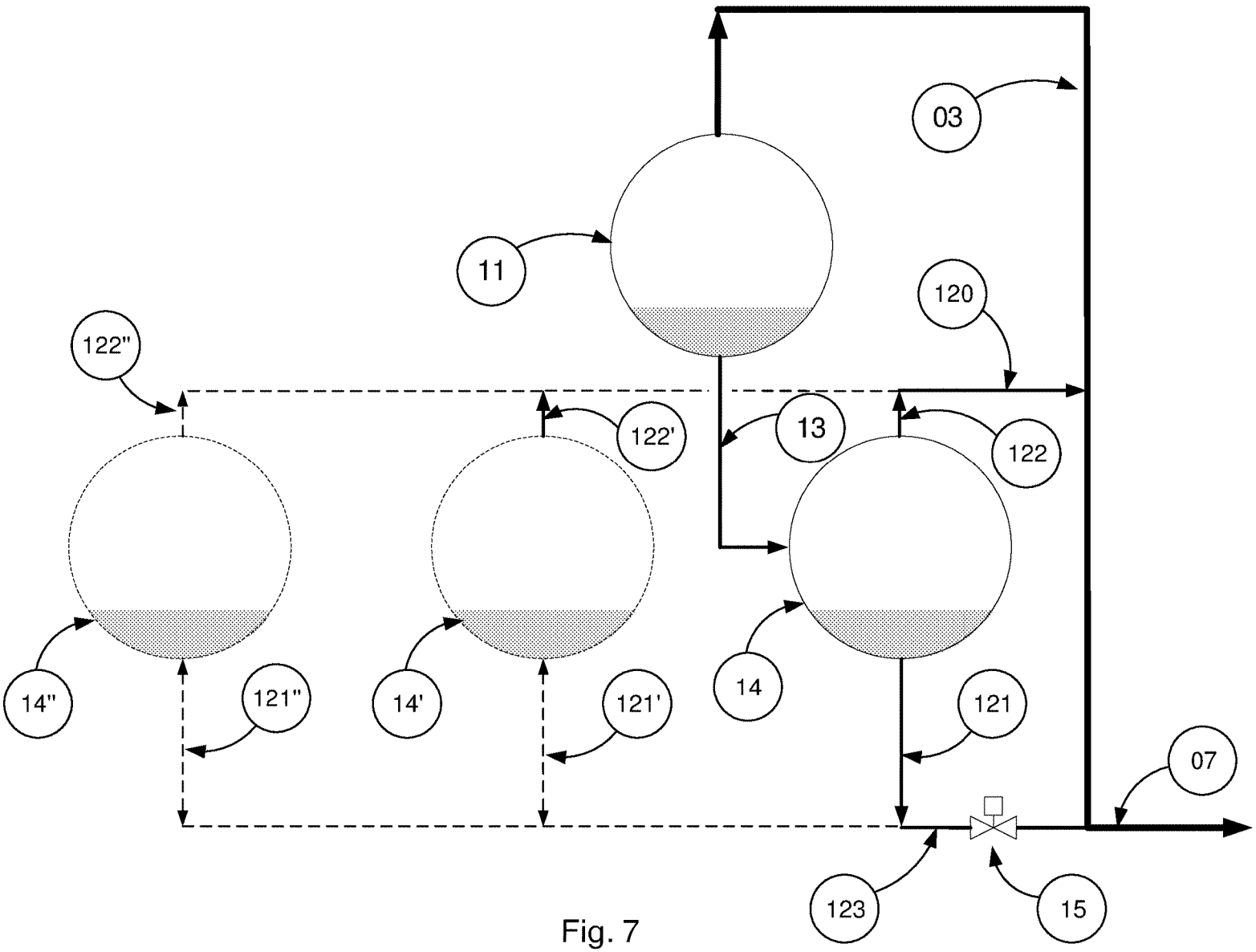
FIG. 7 shows a schematic sectional view of another alternative flow conditioning system according to an embodiment of the invention.

FIG. 7 shows a flow conditioning apparatus comprising a supplementary reservoir 14 similar to that of FIG. 6. However, in FIG. 7 the gas flow from the elongate reservoir 11 is not divided into two flows and all flows along T-pipe 03. The arrangement of FIG. 7 may be used to accommodate large volumes of liquid and gas from the wellhead.

Additional supplementary reservoirs 14' and 14" may be provided in parallel with the supplementary reservoir 14 and may be arranged to receive liquid flow from the elongate reservoir. Each supplementary reservoir 14, 14' and 14" may have their gas outlets connected by pipe sections 122, 122' and 122" respectively to a pipe 120 so that gas flow therefrom combines with gas flow from the elongate reservoir in T-pipe 03. The liquid outlets of each supplementary reservoir 14, 14' and 14" may also be arranged to provide liquid to the pipe 123 via pipe sections 121, 121' and 121" respectively such that liquid combines with the flow in T-pipe 03. A valve 15 may be provided to control the flow rate of liquid to the pipe 07 e.g. for transport to the compressor.

According to the arrangement shown in FIG. 7, the liquid levels in each of the supplementary reservoirs 14, 14' and 14" may be evenly balanced as the pipes therebetween may be open. Thus, greater liquid volume may be accommodated in the apparatus. If the valve 15 is configured to permit less liquid through than is flowing from the supplementary reservoir 14, the excess liquid can flow up pipes 121' and 121" to fill the reservoirs 14' and 14" respectively. Gas can exit those supplementary reservoirs 14', 14" via pipes 122' and 122" to permit them to fill. In the event that a large amount of liquid enters the system and fills all of the supplementary reservoirs, excess liquid can flow from the supplementary reservoirs 14, 14' and 14" through pipe 120 to combine with flow in pipe 03, thereby bypassing the valve 15.

Each supplementary reservoir 14, 14', and 14" may be substantially the same as the elongate reservoir 11 and therefore may be formed of a section of hydrocarbon supply pipeline as described above. Each supplementary reservoir 14, 14' and 14" may be closed at both ends to provide a containing volume.

The additional supplementary reservoirs 14', 14" and so on may be added to the apparatus as needed, and may for example be installed in the apparatus after the apparatus itself has been installed. Any suitable number of supplementary reservoirs can added as needed. Therefore, increases in the total amount of fluid flow from the wellhead can be accommodated by increasing the capacity of the apparatus to accommodate surges of liquid. Flow metering devices may also be applied here as described in FIG. 5. Such devices can be used to adjust the restriction 15 together with a level measurement device between the elongate reservoir 11 and the pipe 123.

Figure 8:
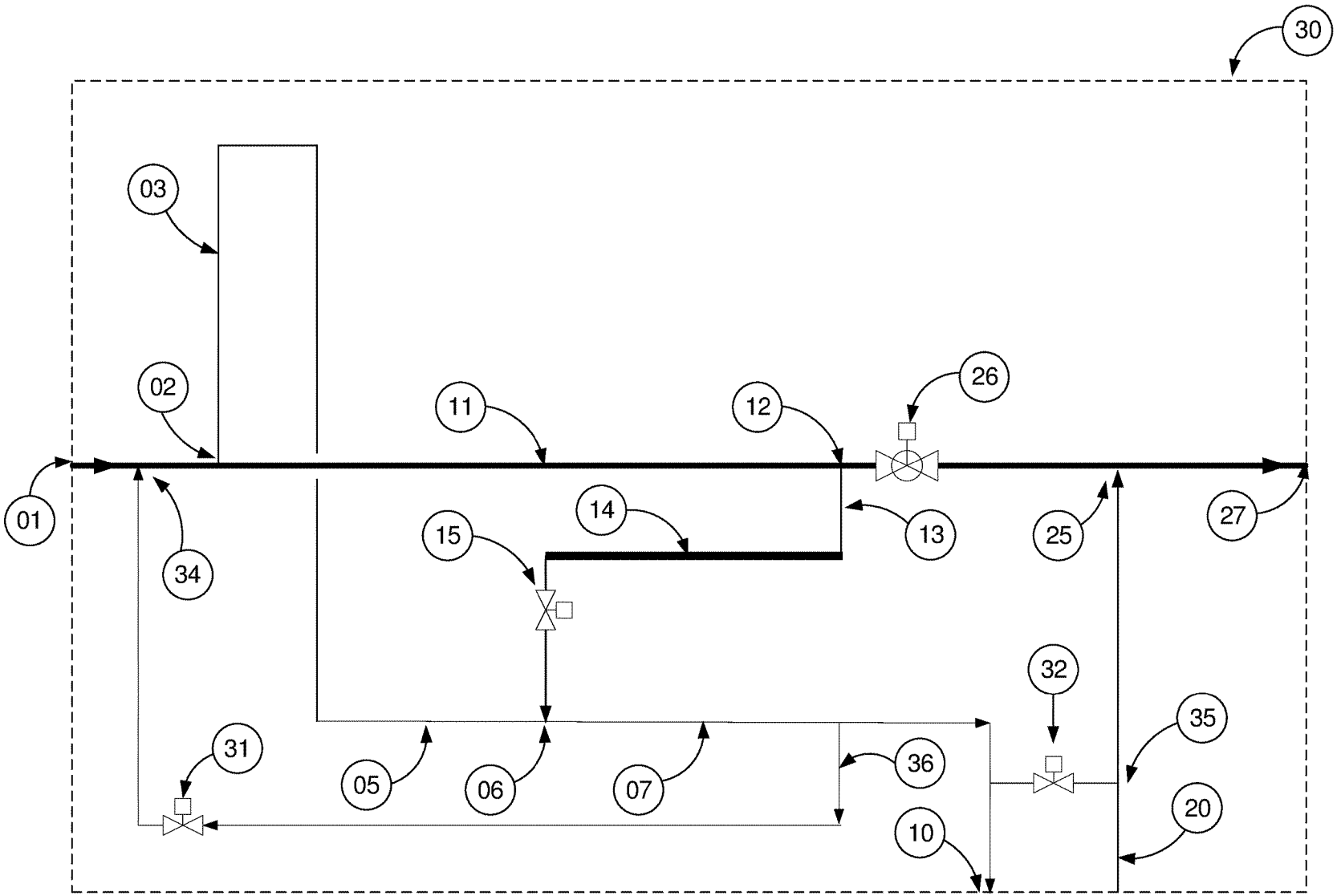
FIG. 8 shows a schematic elevation of a system comprising a flow conditioning apparatus according to an embodiment of the invention.

FIG. 8 shows a schematic arrangement wherein different mechanisms are provided to prevent large reserves of liquid in the supplementary reservoirs from flooding the compressor. In some cases, accumulated liquid in the apparatus may be drained by gravity or forced by gas flow into the compressor inlet flow line e.g. when the compressor is shut down. In such cases, upon start-up a large volume of liquid may be pushed (e.g. by gas) into the compressor having detrimental effects. This issue may be avoided using the arrangement shown in FIG. 8.

Flooding of the compressor in such a situation may be avoided in three ways using the arrangement of FIG. 8. Firstly, the flow restriction device 15 may be used to close or restrict flow of liquid from the supplementary reservoir 14 into the pipe 07 to the suction line 10 of the compressor.

Secondly, the reserve liquid may be drained under gravity to a location 34 upstream of the elongate reservoir 11 via a restriction 31 and a pipe 36. Although FIG. 8 shows the location 34 above the supplementary reservoir 14, the apparatus may be arranged such that the location 34 is below the supplementary reservoir 14 but upstream of the elongate reservoir 11.

Thirdly, the liquid may be drained (e.g. under gravity) to the location 35 of the exit pipe 20 of the compressor via valve 32 so as to bypass the compressor entirely. The valve 32 may be an anti-surge valve and may normally open during a shut down. Alternatively, the pipe joining pipes 10 and 20 may not include a valve (e.g. valve 32) and may simply be narrow so that liquid can pass through it at a predetermined rate.

The compressor itself is controlled by means of a conventional variable speed drive (VSD), with the multi-phase flow meter 09 providing a control input.

Even with the use of the flow conditioner when properly adjusted, there will still be variations in the liquid content of the fluid that is fed to the compressor with time. For a given speed, more liquid requires a higher torque and hence a greater supply of electrical current. The conventional approach is to use the VSD in constant speed mode, which means that the mass-flow from it will vary over time and consequently significantly varying amounts of electrical power are drawn.

The control system of the embodiment involves using the VSD in constant torque mode—i.e. the VSD is instructed to keep the torque at a single value and to allow the speed to drop when more liquid is present—at least when fluctuations in torque exceed a predetermined threshold of 5%. Earlier published application WO 2016/206761 describes constant-speed control (using measurement of the current drawn by a compressor to determine the liquid flow through it). The controller 112 (see FIG. 1) comprises the VSD controller for the compressor and a processor to receive inputs from the multi-phase flow meter controller and/or act upon information about liquid content—e.g. the presence of liquid slugs—upstream of it. The controller 112 also receives and/or acts upon information about the current drawn by the compressor, and/or provides output signals to control the valves and flow restrictors. The controller 112 thus monitors fluid content in and/or upstream of the apparatus via the flow measuring device and compressor current draw in order to control the compressor so as to operate in a constant torque mode when the compressor shaft torque fluctuates too much.

In this way, the controller 112 prevents compressor shaft torque variations due to liquid surging, etc.

As a result, at least where the liquid content causes relatively high shaft torque fluctuations of greater than 5%, the controller will switch control modes of the compressor to maintain a substantially constant torque level. If the liquid content has increased, the speed of the compressor will be reduced in order to maintain a constant torque. Also, since a greater liquid content will result in the compressor generating a higher output pressure, this control regime has the advantage of stabilising the compressor pressure ratio over time.

If the torque does not fluctuate by more than 5%, the controller 112 is configured to control the compressor 110 not to operate in a constant torque mode, and may instead operate in e.g. a constant speed mode. Thus, when torque fluctuations exceed 5%, the controller is configured to switch from its current mode (e.g. constant speed) to the constant torque mode. The controller may be configured to switch to the constant torque mode when the fluctuation of torque is greater than 10% in about one second. The controller may be further configured to switch out of a constant torque mode of operation when another predetermined operating condition is met, or when it is otherwise instructed to do so. The controller 112 may be monitored or controlled remotely (e.g. from shore) via the cable 113.

The fluctuation of the torque may be a change in torque per unit time of the order of a second or so. That is, the torque fluctuation may be change in the total amount of torque in a predetermined time period. Therefore, the controller may switch into a constant torque mode when the torque changes by more than a predetermined threshold amount at greater than a predetermined rate. The change in torque may be a change in the total amount of torque in a given time.

Although the controller 112 is depicted as connected to the compressor via jumper 114, it will be appreciated that it may be integral to the compressor, or the VSD may be integral to the compressor with other components of the controller not integral thereto and disposed remotely.

The invention claimed is:

1. An apparatus for controlling a fluid processing device for compressing a multi-phase flow, wherein the apparatus is configured such that only when a torque fluctuation is above a predetermined threshold, the apparatus switches to controlling the fluid processing device so as to maintain a torque driving the fluid processing device at a substantially constant level as a liquid content of the fluid in the fluid processing device varies with time, wherein the torque fluctuation is a change in the torque per unit time.

2. The apparatus as claimed in claim 1, wherein the fluid processing device is a compressor.

3. The apparatus as claimed in claim 1, wherein the predetermined threshold of torque fluctuation is greater than or equal to 3%.

4. The apparatus as claimed in claim 3, wherein the predetermined threshold of torque fluctuation is greater than or equal to 5% but less than 10%.

5. The apparatus as claimed in claim 4, wherein the predetermined threshold of torque fluctuation is greater than or equal to 5% but less than 7%.

6. The apparatus as claimed in claim 1, wherein the predetermined threshold of torque fluctuation is greater than or equal to 10%.

7. The apparatus as claimed in claim 1, wherein the torque fluctuation is a change in the torque per unit time of the order of a second.

8. The apparatus as claimed in claim 7, wherein the fluctuation of torque is a change in the torque within a timescale of the order of one second.

9. The apparatus as claimed in claim 1, wherein the liquid content is determined based at least partly on a transient level of electrical current drawn by a motor of the fluid processing device.

10. The apparatus as claimed in claim 1, wherein the liquid content is determined from a flow measuring device and/or based at least partly on a machine parameter.

11. The apparatus as claimed in claim 10, wherein the machine parameter is at least one of a shaft position, bearing coil current or an upstream differential or local pressure.

12. A method of controlling a fluid processing device for compressing a multi-phase flow, the method comprising:

monitoring a torque of the fluid processing device; and only when the torque fluctuates by more than a predetermined threshold, switching the fluid processing device to a constant torque mode in which the torque driving the fluid processing device is maintained at a substantially constant level as a liquid content of fluid in the fluid processing device varies with time, wherein the torque fluctuation is a change in the torque per unit time.

13. The method as claimed in claim 12, wherein the fluid processing device is a compressor.

14. The method as claimed in claim 12, wherein the predetermined threshold is greater than or equal to 3%.

15. The method as claimed in claim 14, wherein the predetermined threshold is greater than or equal to 5% but less than 10%.

16. The method as claimed in claim 15, wherein the predetermined threshold is greater than or equal to 5% but less than 7%.

17. The method as claimed in claim 12, wherein the predetermined threshold of torque fluctuation is greater than or equal to 10%.

18. The method as claimed in claim 12, wherein the switching of the fluid processing device comprises switching the fluid processing device out of a constant speed mode in which a speed of the fluid processing device is maintained at a constant level at a predetermined threshold.

19. The method as claimed in claim 12, wherein the torque fluctuation is a change in the total amount of torque per unit time of the order of a second.

* * * * *